United States Patent [19]

Vierra et al.

[11] 4,036,491

[45] July 19, 1977

[54] BODY MASSAGING AND REDUCING BELT

[75] Inventors: Frank C. Vierra; Joyce L. Vierra, both of Maxwell, Calif.

[73] Assignee: The Raymond Lee Organization, Inc., New York, N.Y. ; a part interest

[21] Appl. No.: 666,125

[22] Filed: Mar. 11, 1976

Related U.S. Application Data

[63] Continuation of Ser. No. 579,615, May 21, 1975, abandoned.

[51] Int. Cl.[2] ..... A63B 21/12

[52] U.S. Cl. ..... 272/119; 272/DIG. 4

[58] Field of Search ..... 272/80, 57 R, 119, DIG. 4, 272/94, 93; 173/98, DIG. 17, DIG. 19, 109, 110; 46/47, 51, 49; 128/79, 34, 32, 56, 57; 2/300, 311, 312

[56] References Cited

U.S. PATENT DOCUMENTS

| | | | |
|---|---|---|---|
| 771,938 | 10/1904 | Ruhl | 272/119 X |
| 3,109,651 | 11/1963 | Wheeler | 273/109 |
| 3,332,166 | 7/1967 | Alexander | 46/49 X |
| 3,348,333 | 10/1967 | Cascioli | 46/51 |
| 3,843,117 | 10/1974 | Johnson | 272/128 |

FOREIGN PATENT DOCUMENTS

| | | | |
|---|---|---|---|
| 636,754 | 2/1962 | Canada | 273/109 |

*Primary Examiner*—Richard J. Apley
*Assistant Examiner*—William R. Browne
*Attorney, Agent, or Firm*—Daniel Jay Tick

[57] ABSTRACT

A body massaging and reducing belt comprises a trough-like, belt-like member adapted to be worn around the body of a user desiring to lose weight. A pluality of balls are provided in the trough-like member free to rotate therein and to shift and engage the sides of the member. The trough-like member is adjustably fastened at its ends for adjustably affixing it to the body of the wearer.

2 Claims, 6 Drawing Figures

BODY MASSAGING AND REDUCING BELT

This application is a continuation of application Ser. No. 597,615, filed May 21, 1975, now abandoned.

DESCRIPTION OF THE INVENTION

The present invention relates to a reducing belt device. More particularly, the invention relates to a body massaging and reducing belt.

Objects of the invention are to provide a reducing belt device of simple structure, which is inexpensive in manufacture, used with facility, comfort and convenience and functions efficiently, effectively, reliably and painlessly to reduce the weight of a user.

In order that the invention may be readily carried into effect, it will now be described with reference to the accompanying drawing, wherein.

In the FIGS., the same components are identified by the same reference numerals.

Figure 1:
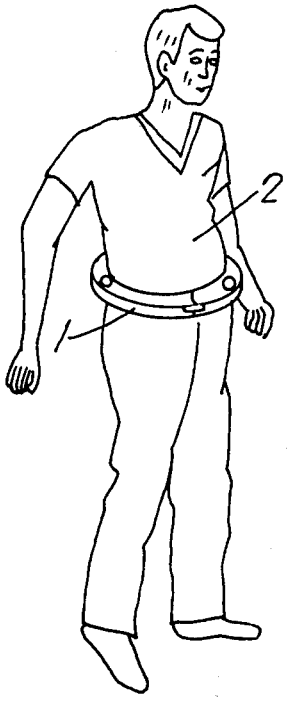
FIG. 1 is a perspective view of an embodiment of the reducing belt device of the invention in use.
Figure 2:
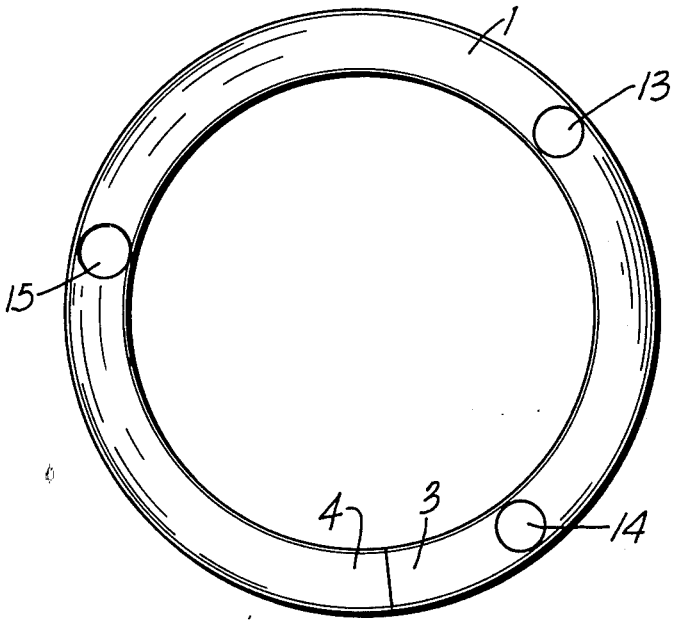
FIG. 2 is an axial view, on an enlarged scale, of an embodiment of the reducing belt device of the invention.
Figure 3:
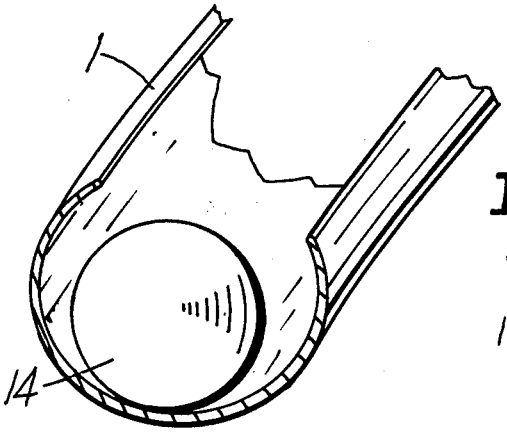
FIG. 3 is a cutaway view, partly in section, on an enlarged scale, of part of the embodiment of FIG. 2.
Figure 5:
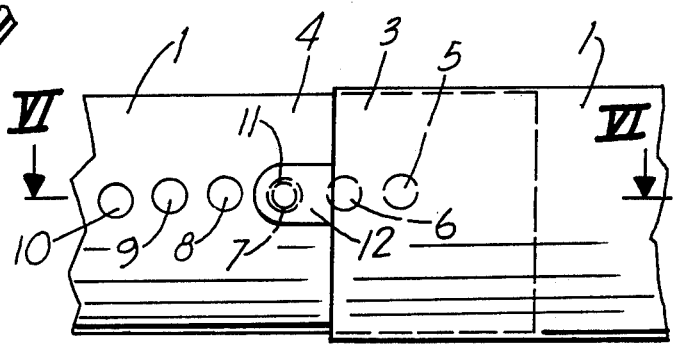
FIG. 5 is a view, on an enlarged scale, illustrating an embodiment of a fastening device of the reducing belt device of the invention.
Figure 6:
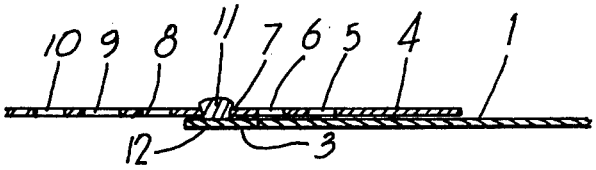
FIG. 6 is a cross-sectional view, taken along the lines VI—VI, of FIG. 5.

The reducing belt device of the invention comprises a substantially trough-like, substantially belt-like member 1. The member 1 is adapted to be worn around the body 2 of a user (FIG. 1) desiring to lose weight. The member 1 has two opposite ends 3 and 4 (FIGS. 2, 5 and 6).

An adjustable fastening device is provided on the trough-like member in the area of the ends 3 and 4 thereof for adjustably affixing said ends to each other when the member is positioned around the body of the user. The fastening device comprises a plurality of boxes 5, 6, 7, 8, 9 and 10 (FIGS. 5 and 6) formed through the member 1 at the end 4 thereof in spaced linear arrangement. A projecting member 11 is affixed to a flexible tab 12, extending from the end 3 of the member 1, as shown in FIGS. 5 and 6, and is inserted into a selected one of the holes 5 to 10 in the manner of a belt and belt buckle.

Figure 4:
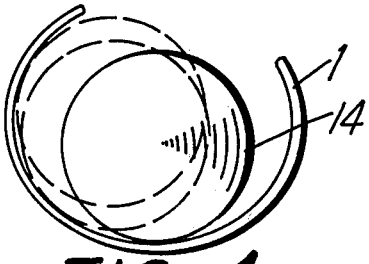
FIG. 4 illustrates possible movement of a ball in the trough-like member of the embodiment of FIG. 2.

In accordance with the invention, a plurality of balls 13, 14 and 15 (FIG. 2) are provided in the trough-like member 1 free to rotate therein. Thus, as the user walks or moves, the balls 13, 14 and 15 shift around, in the manner shown in FIG. 4 and result in a gentle massaging, toning and reducing contact with the body of the user.

While the invention has been described by means of a specific example and in a specific embodiment, we do not wish to be limited thereto, for obvious modifications will occur to those skilled in the art without departing from the spirit and scope of the invention.

We claim:

1. A body massaging and reducing belt, comprising a substantially trough-like means being a substantially belt-like member and having free end portions and adapted to be worn around the waist area of a user desiring to lose weight, said means comprising a channel extending continuously between said free ends, said channel being open upwardly and having a side that engages the body of the user; and a plurality of balls in the trough-like member free to rotate therein and shifting in said member during movement of the waist area of a user to gently massage and tone the body of the user and to reduce the user's weight.

2. A reducing belt device as claimed in claim 1, further comprising adjustable fastening means on the trough-like member in the area of the ends thereof for adjustably affixing said ends to each other when said member is positioned around the body of the user.

* * * * *